US006708532B2

(12) United States Patent
Winland

(10) Patent No.: US 6,708,532 B2
(45) Date of Patent: Mar. 23, 2004

(54) HINGED SECURITY COVER FOR VEHICLE DOOR HASP

(75) Inventor: Brian Winland, Wildomar, CA (US)

(73) Assignee: Ryadon, Inc., Foothill, CA (US)

( * ) Notice: Subject to any disclaimer, the term of this patent is extended or adjusted under 35 U.S.C. 154(b) by 0 days.

(21) Appl. No.: 10/219,233

(22) Filed: Aug. 15, 2002

(65) Prior Publication Data

US 2004/0031297 A1 Feb. 19, 2004

(51) Int. Cl.[7] ..... E05B 65/48

(52) U.S. Cl. ..... 70/2; 70/56; 70/417; 70/212; 292/DIG. 32

(58) Field of Search ..... 70/2, 54–56, 417, 70/212; 292/200, 205, 212, 218, 327, DIG. 32

(56) References Cited

U.S. PATENT DOCUMENTS 547,550 A * 10/1895 Hopkins ..... 70/56
3,736,016 A 5/1973 Garvey et al. ..... 70/56 X
3,968,665 A * 7/1976 Kaufmann ..... 70/234
4,113,291 A * 9/1978 Cameron ..... 292/40
4,194,775 A * 3/1980 Shea ..... 292/307 R
4,286,814 A * 9/1981 Harrington et al. ..... 292/281
4,322,102 A * 3/1982 Lindblom ..... 70/2 X
4,566,296 A * 1/1986 Kochakis ..... 70/56
4,852,920 A * 8/1989 DeForrest, Sr. ..... 292/205
4,898,008 A 2/1990 Eberly ..... 70/56
5,118,149 A 6/1992 Emmons ..... 70/56 X
5,154,458 A * 10/1992 Cook et al. ..... 70/417 X
5,172,574 A * 12/1992 Perfetto ..... 70/56
5,284,036 A * 2/1994 Rosenbaum ..... 70/56 X
5,307,653 A * 5/1994 Davis ..... 70/56
5,692,401 A * 12/1997 Khalsa ..... 292/DIG. 32 X
5,737,946 A * 4/1998 Sole et al. ..... 70/54
5,743,118 A * 4/1998 Anderson ..... 70/56
5,934,116 A * 8/1999 Moore ..... 70/212
5,946,952 A * 9/1999 Mintchenko ..... 70/2
5,975,595 A * 11/1999 Lorenzo ..... 292/205
6,058,745 A * 5/2000 Sanchez ..... 70/56
6,463,769 B1 * 10/2002 Garner ..... 70/56
6,464,269 B1 * 10/2002 Wilhelm et al. ..... 70/2 X

* cited by examiner

*Primary Examiner*—Suzanne Dino Barrett
(74) *Attorney, Agent, or Firm*—Fulwider Patton Lee & Utecht

(57) ABSTRACT

A security device for a vehicle door or shipping container hasp includes a hinged cover with a window that permits the hasp to partially project thereinthrough, and a lock for fixing the cover in an overlaying relationship with the hasp. The cover includes slots on the side for bypassing a lever held by said hasp, and otherwise shields the hasp from intrusion from a prying tool.

10 Claims, 5 Drawing Sheets

HINGED SECURITY COVER FOR VEHICLE DOOR HASP

BACKGROUND OF THE INVENTION

1. Field of the Invention

The present invention relates generally to locking mechanisms for vehicle doors and shipping containers, and more particularly to a hinged security cover for a locking mechanism to protect the locking mechanism from vandalism.

2. Description of the Prior Art

Many cargo trucks and trailers, cargo train cars, and various other transport vehicles have a swing out door or doors that provide access to the transported items. The swing out doors are typically secured by an assembly that includes a closure mechanism to prevent the door or doors from opening inadvertently. A common closure mechanism is shown in FIG. 1 and includes a vertical cam rod that mounts to a door and is capable of displacement along its longitudinal axis. When the vertical cam rod is shifted vertically, a keeper on the vehicle frame receives the end of the vertical cam rod blocking the door from opening. The vertical cam rod includes a lever positioned along the length of the vertical cam rod so as to be aligned with a pair of brackets when the vertical cam rod is disposed within the keeper. By securing the lever between the brackets, the vertical cam rod is held within the keeper and the door is fixed in the closed position. The brackets are designed such that one or both of the brackets swivel about their mount to permit the lever to enter the space therebetween, and then the brackets may then be swivelled together and locked in a closed position to prevent unauthorized personnel from entering the vehicle. The brackets are formed with a hasp structure at their ends that includes a pair of holes aligned to be received by a padlock or other locking hardware (not shown) to secure the brackets about the captured lever. To secure the door, the user moves the vertical cam rod vertically into the keeper and then rotates the lever into position between the brackets. The brackets are then swivelled together and a padlock is passed through the hasp formed by the brackets, fixing the vertical position of the cam rod and preventing the door from opening. With the padlock removed, the brackets can be swivelled apart and the lever can be released and moved down to release the cam rod from the keeper and thus permit the swing out door to open. The foregoing arrangement is well established in the art, and is also used on shipping containers. The following discussion is applicable to both vehicle applications as well as shipping container applications.

The problem with the above described configuration and with any similar arrangements whereby a hasp and padlock are used in conjunction to prevent unwanted entry into a cargo area, is that the padlock security feature can be defeated in some cases by directly prying the hasp device off at its base with a crow bar or similar tool. By prying off the hasp, the lever can be freed without the key or combination to the padlock and non-authorized personnel can quickly access and raid the cargo contents. Accordingly, a simple, effective security feature is needed to resist the removal of the hasp of the prior art with a prying tool or the like.

SUMMARY OF THE INVENTION

The present invention provides a security cover for a hasp-lock combination that thwarts a would-be thief by denying access to the base of the hasp. The security cover comprises a rigid shell that pivots about a hinge member over the brackets that form the hasp. The distal portion of the hasp that carries the padlock projects through a window in the shell while the base is shielded by the shell. The shell preferably mates flush with a base plate that also seats the brackets forming the hasp to enclose the hasp. The shell preferably supports a cam lock to control the opening and closing of the shell and limits access to the hasp's base. In conjunction with the cam lock, the base plate may include a raised extruded strip that forms a hook for retaining a rotating lock tab, precluding the shell from pivoting open when the lock is in the closed position.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

Figure 1A:
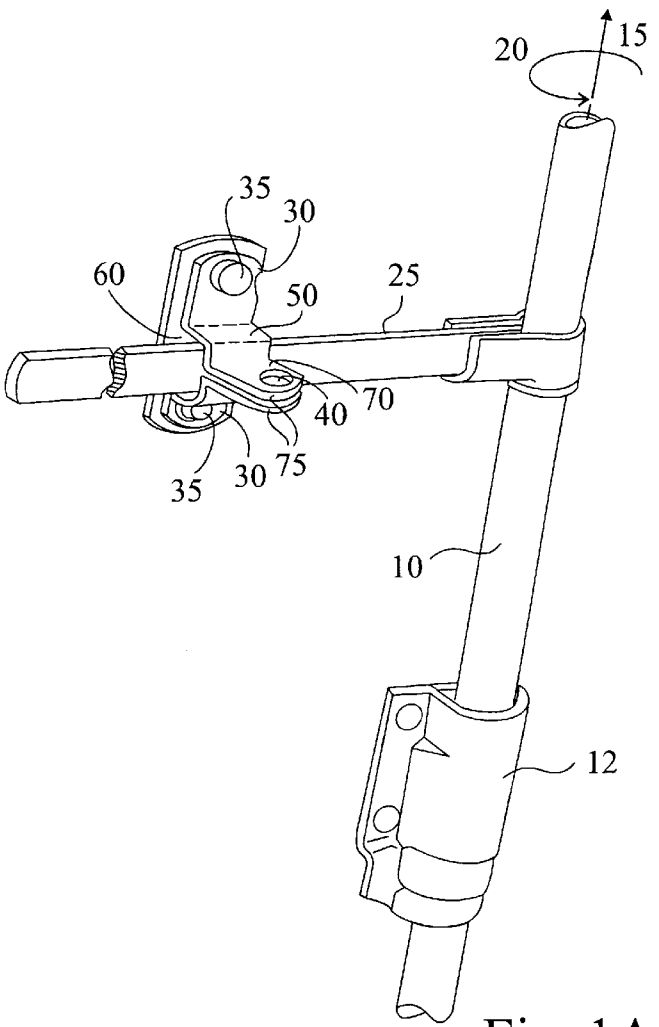
Fig. 1A (Prior Art)
FIG. 1A is an enlarged view of the encircled area of FIG. 1.
Figure 1:
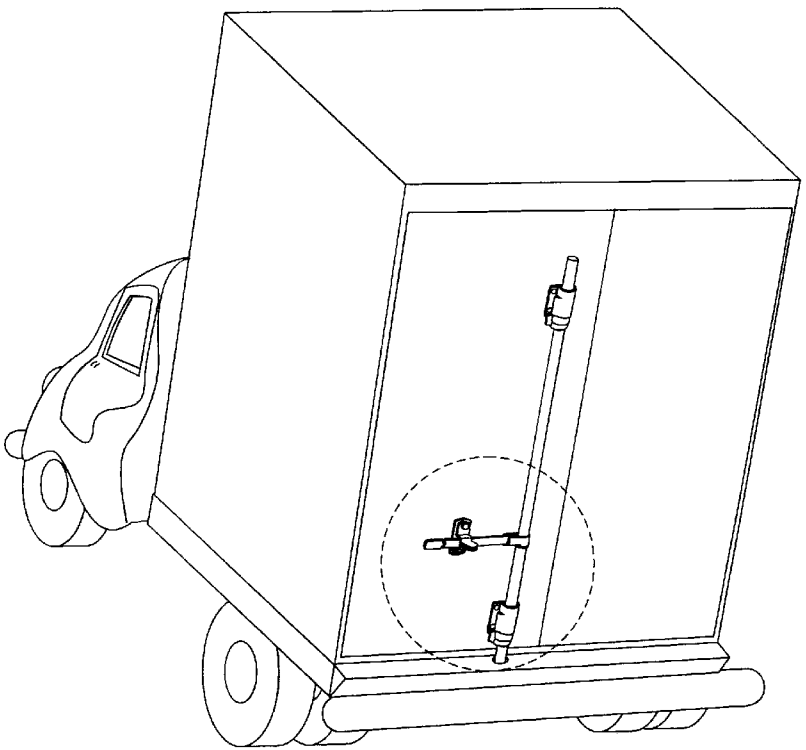
Fig. 1 (Prior Art)
FIG. 1 is an elevated perspective view of the cam rod and lever assembly of the prior art.

FIGS. 1 and 1A show the environment that the present invention may be found such as a swing out type vehicle door. A vertical cam rod 10 is mounted by a plurality of lugs or mounting brackets 12 that support rotation of the cam rod about its longitudinal axis 15. Near the end(s) of the cam rod and mounted to the vehicle frame is a keeper that can receive the end of the cam rod and hold the cam rod therein. A lever 25 is secured to the cam rod at a middle portion and can be used to raise and lower the cam rod 10 into the keeper, where the swing out door is free to open when the cam rod is outside the keeper but is prevented from opening when the cam rod is located in the keeper. To maintain the cam rod in the keeper during transit and when the vehicle is unattended, a pair of brackets 30 are mounted on the vehicle door at the height of the lever 25 when the cam rod 10 is located in the keeper. Once the cam rod is raised or lowered into the keeper using the lever, the lever is rotated about its longitudinal axis until it is located adjacent the pair of brackets. To allow the lever to be held by the brackets, one or both of the brackets swivel about their respective mountings 35 to separate and open for receiving the lever. The lever is then placed between the brackets, where a stepped portion 50 of each bracket forms a compartment 60 that receives the lever. As the brackets are swivelled closed, a distal portion 70 of each bracket projects perpendicularly from the plane of the vehicle door and are adapted to form a hasp 75 for locking the lever within the brackets. This configuration permits the door to be secured in a closed position but lacks a means for protecting the hasp from being pried off to defeat the security of the lock.

Figure 2:
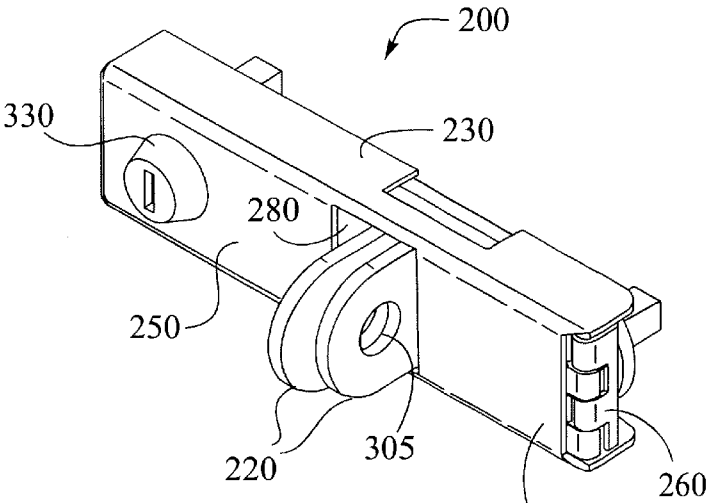
FIG. 2 is an elevated perspective view of an embodiment of the security cover.
Figure 5:
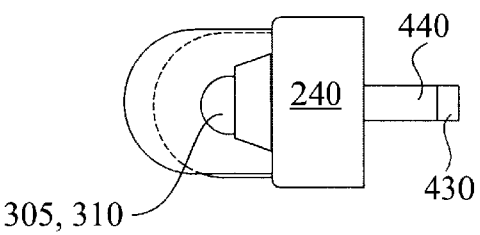
FIG. 5 is a side view of the security cover of FIG. 2.
Figure 3:
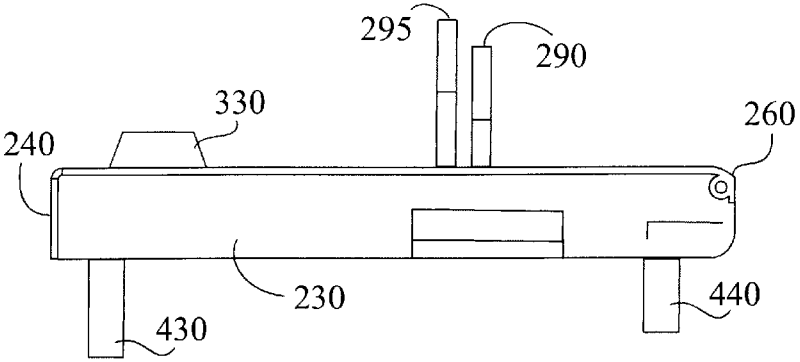
FIG. 3 is a top view of the security cover of FIG. 2.
Figure 4:
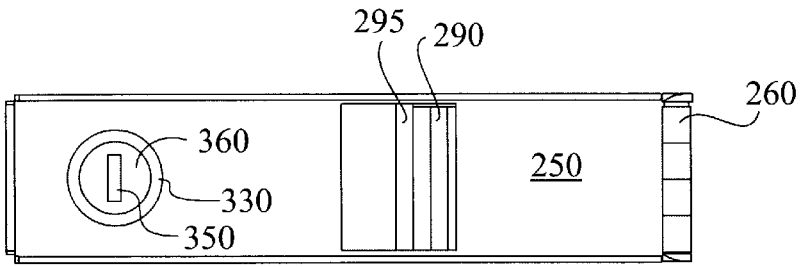
FIG. 4 is a front view of the security cover of FIG. 2.
Figure 12:
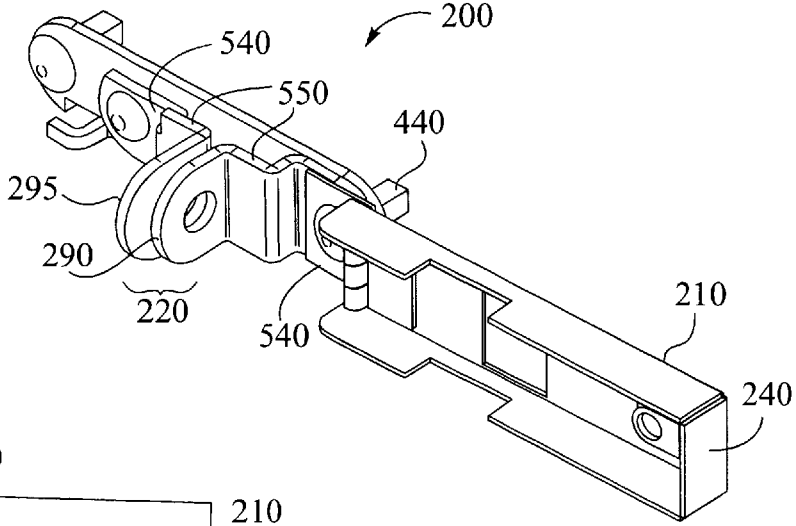
FIG. 12 is an elevated perspective view of the security cover of FIG. 2 in the open position.
Figure 15:
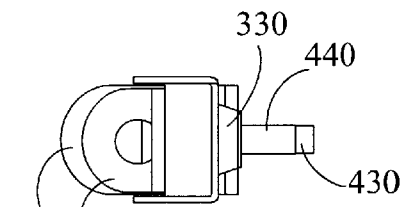
FIG. 15 is a side view of the security cover of FIG. 2 in the open position.

Referring now to the remaining Figures and in particular to FIGS. 2 and 12, a security cover 200 for a hasp-lock combination is provided to resist efforts of a would-be vandal to pry the hasp-lock combination off of its mounting surface. The cover comprises a hinged rigid enclosure or shell 210 for pivotally overlaying a hasp 220 such that the juncture of the hasp and its mounting surface is protected by said shell. In a preferred embodiment the shell 210 is rectangular and includes a pair of side walls 230 and an end wall 240, and a top panel 250. The shell 210 is connected to a hinge member 260 (see FIG. 10) located adjacent to the hasp, such as with a pivot plate 270. The top panel 250 includes a window 280 located over the projecting plates 290,295 that make up the hasp 220 when the shell 210 is pivoted over the hasp. The window allows the hasp to partially extend through the top panel such that the plates' aligned holes 305,310 extend to the exterior of the compartment defined by the shell 210 and its walls.

Figure 6:
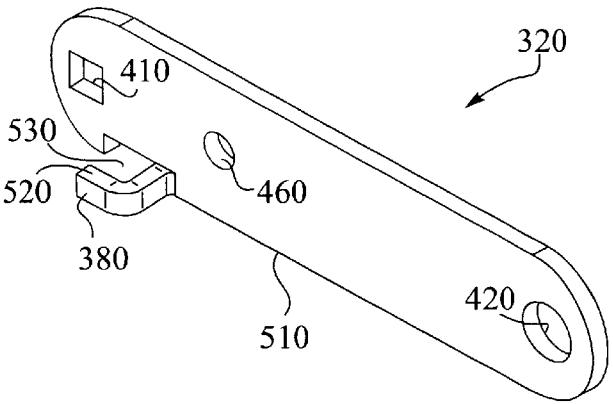
FIG. 6 is an elevated perspective view of a base plate of the security cover of FIG. 2.
Figure 9:
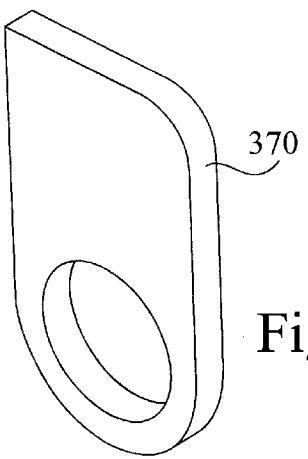
FIG. 9 is an elevated perspective view of the cam lock tab of the security cover of FIG. 2.
Figure 8:
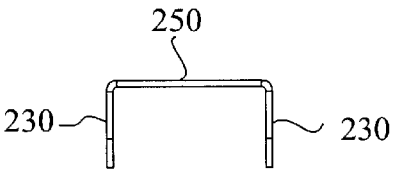
FIG. 8 is a longitudinal side view of the shell of FIG. 7.

The cover 200 may further include a base plate 320 generally shown in FIG. 6 that is preferably secured directly to the vehicle door, and the base plate and shell are pivotally connected by the adjoining hinge member 260. The hinge member 260 allows the shell 210 to pivot over the base plate 320 and enclose the attachment point of the hasp 220, and then pivot away from the hasp to provide access to the captured lever when opening or closing the door. When pivoted over the hasp, the shell may be locked onto the base plate by a key-actuated cam lock 330 on the top panel 250. The lock 330 is disposed within a fitted hole 340 in the top panel with a keyhole 350 oriented on the upper surface 360 for rotatably receiving a key (not shown). The cam lock 330 includes a cam lock tab 370 (see FIGS. 9, 11) located beneath the top panel. The cam lock tab is coupled to the orientation of the keyhole, i.e., a rotation of the key within the keyhole causes a corresponding rotation of the cam lock tab 370 inside the shell 210. The unlocked and locked positions of the keyhole correspond respectively with the cam lock tab being located outside of, and within, a hook 380 sized to receive the locking tab on the base plate 320. When locked, the cam lock tab 370 is captured in the recess defined by the locking hook 380 and prevents the shell from pivoting open about the hinge member 260. When unlocked, the cam lock tab lies outside of the locking hook and the shell is free to pivot about the hinge member.

The base plate 320 connects to the vehicle door and receives the complimentary brackets 390, 395 that cooperate to form the hasp 220. The base plate is preferably a unitary sheet having first and second holes 410, 420 at respective ends for fastening the base plate to the intended wall or door. The holes are sized to each receive square pins 430, 440 (see FIG. 11), the first hole 410 being square for a fitted reception of the square pin 430, and the second hole 420 being round for circumscribing the square pin 440. The square pin 440 passing through the round hole 420 also passes through a hole 450 on one of said complimentary brackets 390, where the hole 450 may be square to prevent the bracket 390 from swiveling freely about the square pin 440. A third hole 460 on the base plate 320 inward of the first hole 410 is sized to receive a rivet 470 for securing the second complimentary bracket 395 to the base plate at hole 480. The rivet permits rotation of the second bracket 395 such that the second bracket can swivel freely from a capture position adjacent the bracket 390 to an open position rotated one hundred eighty degrees, allowing the cam rod lever to ingress and egress the designated compartment 490 between the brackets.

The base plate 320 is generally rectangular with respective ends of the base plate preferably rounded. At a first lateral edge 510 of the plate between the first and third apertures, a strip of plate material is cut along two sides and extruded out of plane to form a hook 380 as shown in FIG. 6. The leg 520 of the h-shaped hook cooperates with the base plate to define an open-ended slot 530 above the base plate for receiving the cam lock tab 370 connected to a lock 330 on the top panel 250 of the shell 210. With the lock tab rotatably captured inside the open slot, the shell is coupled to the base plate and thereby prevented from rotating about the hinge member 260.

Figure 13:
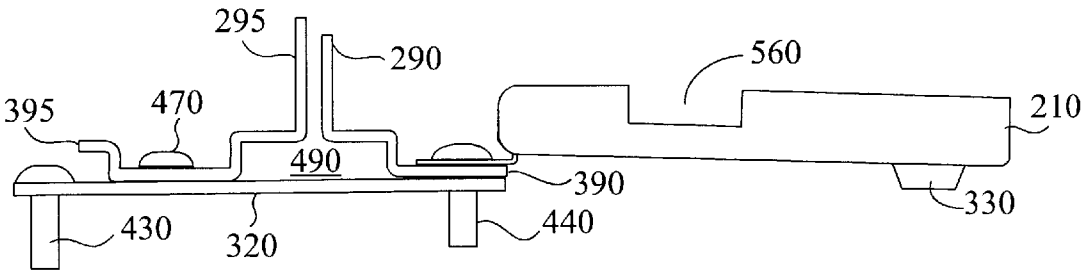
FIG. 13 is a top view of the security cover of FIG. 2 in the open position.

With the base plate 320 mounted to the vehicle wall or door to be secured, the two complimentary brackets 390, 395 that form the hasp 220 are mounted to the base plate as shown in FIG. 12. Each bracket comprises a plate having a flat mounting portion 540 at a first end that includes a hole for receiving the respective square pin or rivet, and a step-shaped intermediate portion 550 leading to an orthogonal projecting panel 290,295 with a hole 305,310 for receiving the padlock (not shown). The step-shaped intermediate portion 550 on each bracket cooperate to form a rectangular compartment 490 or space for capturing the lever between the brackets 390,395. When the brackets are closed together by the swiveling bracket 395 about rivet 470, the orthogonal projecting panels 290, 295 are in a parallel spaced apart relation as shown in FIG. 13 and form the hasp 220.

Figure 11:
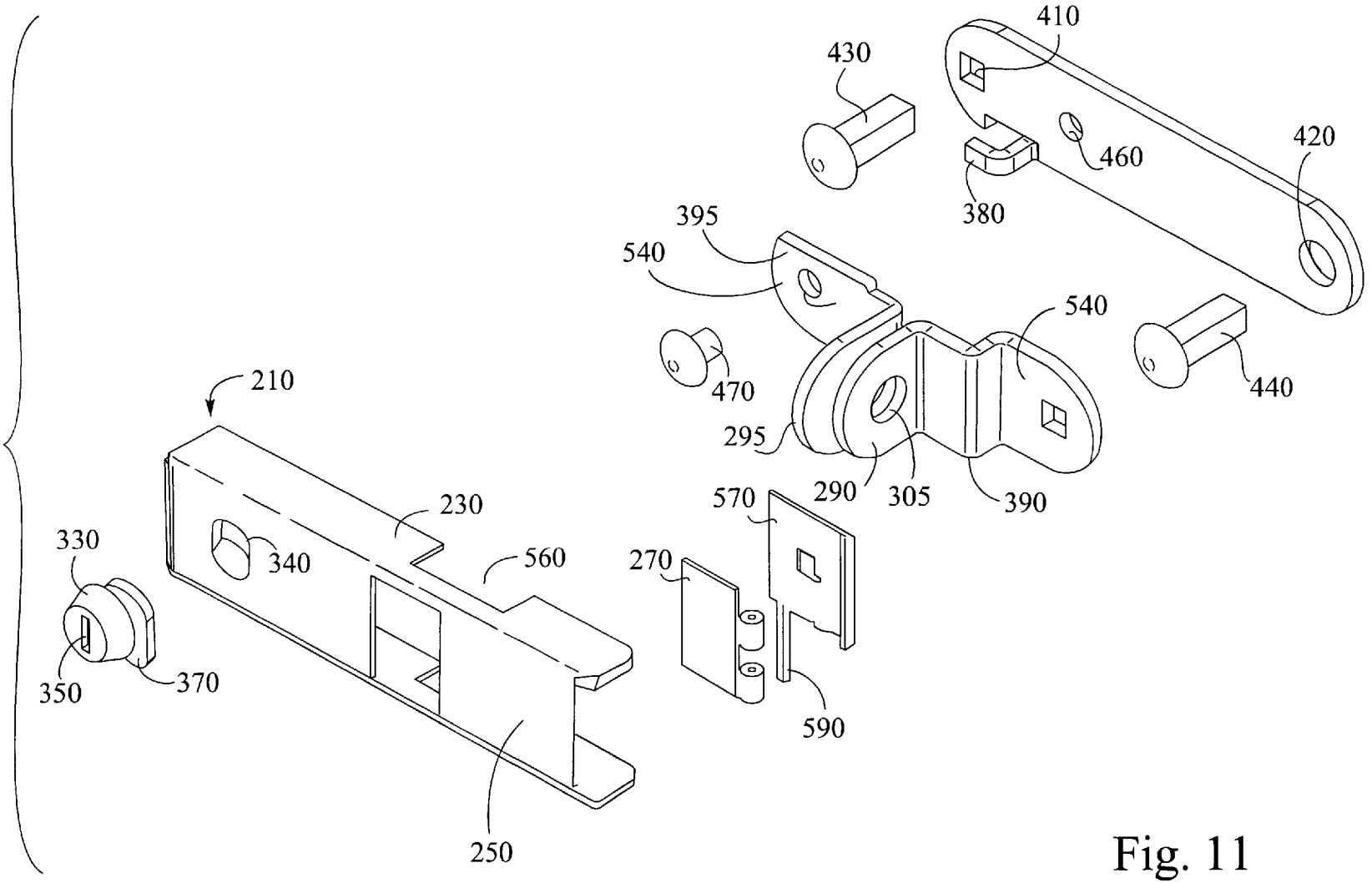
FIG. 11 is an elevated exploded view of the security cover of FIG. 2.
Figure 14:
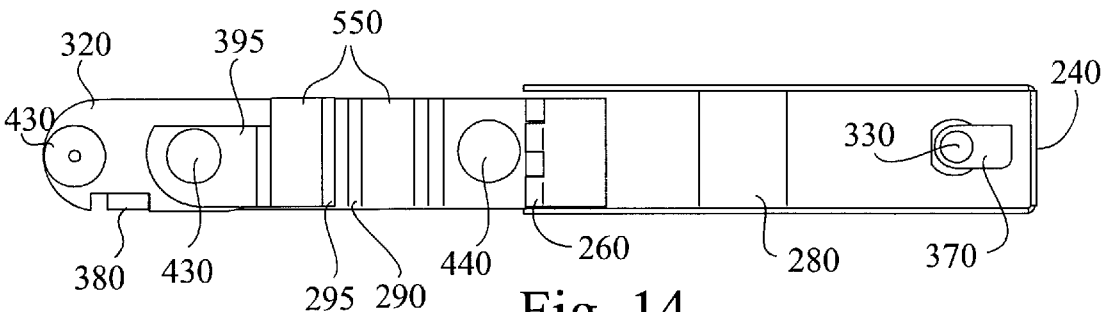
FIG. 14 is a front view of the security cover of FIG. 2 in the open position.

The shell 210 for the security cover 200 may be shaped as a rectangular open box with a top panel 250, two side walls 230, and an end wall 240. The end opposite the end wall and the bottom of the shell are open. Along each side wall 230 is a rectangular slot 560 sized to fit over the lever such that the shell 210 can fit over the lever and mate with base plate 320 with the lever extending traversely through the security cover 200. The top panel 250 of the shell has a window 280 located where the two projecting panels 290, 295 of the hasp 220 are located, such that the hasp projects partially through the window with the holes 305, 310 on the projecting panels 290, 295 lying outside the window 280 as shown in FIG. 2. The top panel further includes an opening 340 that receives the cam lock 330 therein. The location of the cam lock is selected to be adjacent the slot 530 formed by the hook 380 on the base plate 320 such that the cam lock tab 370 coupled to the cam lock can rotate into and out of said slot. The cam lock tab is supported on the cam lock within the shell against the top panel, and rotates with the lock as a key (not shown) turns the lock. When the lock is in the open position and the cam lock tab is aligned longitudinally with the shell as shown in FIG. 14, the cam lock tab is not located in the hook and the shell can pivot freely about the hinge member 260. However, when rotated into a position traverse with the shell as shown in FIG. 11, the cam lock tab rotates into the slot defined by the hook thereby capturing the cam lock tab and thus the attached shell. In this position, the shell cannot rotate about the hinge member and the security cover 200 is locked onto the base plate enclosing the base of the hasp.

Figure 10:
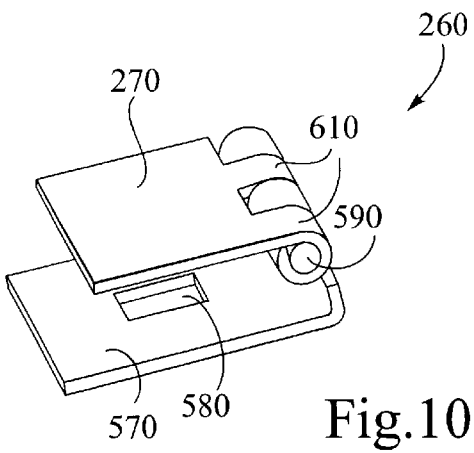
FIG. 10 is an elevated perspective view of the hinge member of the security cover of FIG. 2.
Figure 7:
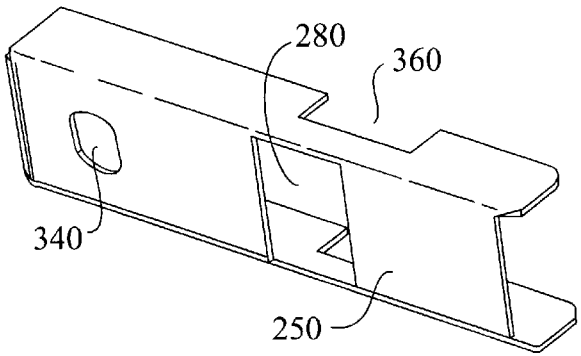
FIG. 7 is an elevated perspective view of a shell of the security cover of FIG. 2.

The hinge member 260 is generally shown in FIG. 10 and comprises a first mounting plate 570 that includes a square hole 580 for passing the square pin 440 through (see FIG. 11), securing the first mounting plate 570 to the first bracket 390 at the flat mounting portion 540. A pivot plate 270 is adhered to the bottom surface of the top panel 250 of the shell 210, by welding, adhesive bonding, or other adhering method. The mounting plate 570 and the pivot plate 270 are connected in a hinged relationship by the adjoining hinge rod 590 and cooperating curled hinge rod connectors 610, such that the pivot plate 270, and therefore the shell 210, pivots about the hinge member 260 to open and close the security cover 200 over the hasp assembly.

In operation, the base plate 320 of the present invention is secured to the door of the truck or other vehicle at the location where the hasp is to be located by providing square holes to receive the square pins 430,440. The square pin 430 passes through the square hole 410 of the base plate at a first end, and the square pin 440 passes through the square hole 450 of the bracket 390, the mounting plate 570 of the hinge member 260, and circular hole 420 of the base plate at the opposite end. The second bracket 395 is then mounted to the base plate by inserting a rivet 470 through the round hole 480 of the bracket and the third hole 460 of the base plate such that the second bracket rotates about the rivet from an open position away from the first bracket, to a closed position adjacent the first bracket. When the vehicle door is to be secured, the cam rod is shifted vertically until the end of the rod is located in the keeper, and the lever/handle is placed between the brackets with the second bracket rotated in the open position. With the lever in the space between the two brackets, the second bracket is rotated closed until the respective projecting panels are adjacent and the holes in the projecting panels are aligned. Using the hinge member, the shell of the security cover is pivoted closed over the projecting panels until the shell is flush with the base plate. The hasp projects substantially through the window in the top panel of the shell and the lever extends through the security cover at the rectangular slots on the side walls. A key is inserted into the cam lock, and the cam lock is rotated from the open position to the locked position, locating the cam lock tab inside the shell and adjacent the base plate hook into the h-shaped slot defined by the hook, and fixing the security cover in the closed position. A padlock or other locking hardware is placed in the hasp through the aligned holes to secure the lever in the position between the brackets, and the connection of the hasp with its mounting surface is protected by the security cover from access without a key to the cam lock.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A security cover for a hasp for use on vehicles with a swing out door as well as shipping containers, the security cover comprising:

a shell pivotally mounted on a hinge member adjacent the hasp for pivotally overlaying the hasp when pivoted about said hinge, the shell comprising a window positioned to receive a portion of the hasp thereinthrough when the shell overlays the hasp, said portion of the hasp projecting through the shell window including an end portion with an aperture therein for receiving a lock; and a lock on the shell to releasably secure the shell in overlaying relationship about said hasp.

2. The security cover of claim 1 further comprising:

a base plate cooperating with the shell and mounted to the vehicle door, said base plate formed with a locking hook extending away from said base plate; and said lock is formed with a rotatable locking tab configured to rotatably engage said locking hook to lock said shell in overlaying relationship about said hasp.

3. A security cover for a hasp for use on vehicles with a swing out door as well as shipping containers, the security cover comprising:

a shell pivotally mounted on a hinge member adjacent the hasp for pivotally overlaying the hasp when pivoted about said hinge, the shell comprising a window positioned to receive a portion of the hasp thereinthrough when the shell overlays the hasp;

a lock on the shell to releasably secure the shell in overlaying relationship about said hasp;

a base plate cooperating with the shell and mounted to the vehicle door, said base plate formed with a locking hook extending away from said base plate;

said lock is formed with rotatable locking tab configured to rotatably engage said locking hook to lock said shell in overlaying relationship about said hasp; and wherein the hasp includes opposing hasp brackets mounted on said base plate and configured to cooperate in locking said hasp, and where at least one hasp bracket swivels about a mounting on the base plate.

4. A security cover for a hasp for use on vehicles with a swing out door as well as shipping containers, the security cover comprising:

a shell pivotally mounted on a hinge member adjacent the hasp for pivotally overlaying the hasp when pivoted about said hinge, the shell comprising a window positioned to receive a portion of the hasp thereinthrough when the shell overlays the hasp; and a lock on the shell to releasably secure the shell in overlaying relationship about said hasp; wherein the shell includes side walls having edges that form a substantially rectangular seating perimeter, said seating perimeter being configured to be substantially in contact with said base plate when said shell is pivoted into overlaying relationship with said hasp, and said side walls further comprising slots for receiving therein a lever used to open the door.

5. A security cover for a hasp for use on vehicles with a swing out door as well as shipping containers, the security cover comprising:

a shell pivotally mounted on a hinge member adjacent the hasp for pivotally overlaying the hasp when pivoted about said hinge, the shell comprising a window positioned to receive a portion of the hasp thereinthrough when the shell overlays the hasp; and a lock on the shell to releasably secure the shell in overlaying relationship about said hasp; wherein a padlock is installed on said portion of said hasp extending through said window.

6. A security device for a hasp including respective hasp brackets, each said bracket having a mounting end and a locking end, said device comprising:

a security enclosure pivotably installed adjacent said hasp and configured to pivot between an open position and a closed position, said security enclosure being formed such that in said open position said mounting ends and said locking ends are accessible and in said closed position said security enclosure is in an overlaying relationship about said hasp such that only said locking ends are accessible; and a lock installed on said security enclosure and configured to lock said security enclosure in said closed position.

7. A security lock for a hasp, wherein:

said hasp is comprised of:

an elongate base plate configured at opposite first and second ends with respective first and second mounting holes;

first and second base plate fasteners installed within respective said first and second mounting holes to secure said base plate to a mounting surface;

a first hasp bracket installed on said base plate by said first base plate fastener, said first hasp bracket being further configured with a first locking hole;

a second hasp bracket movably mounted on said base plate and having a second locking hole, said second hasp bracket being configured to move toward said first end so as to be substantially adjacent to said first hasp bracket and bring said second locking hole into substantial alignment with said first locking hole;

said security lock is comprised of:

a hinge having a hinge mounting plate and a hinge pivot plate interconnected along a hinge joint, said hinge mounting plate being attached to said base plate by said first base plate fastener such that said hinge joint is substantially aligned with said first end; and an elongate security cover installed on said hinge pivot plate, said security cover being configured to pivotably project coextensive with said base plate and being further configured with a bracket opening for receipt therethrough of said first and second hasp brackets when said second hasp bracket is moved substantially adjacent to said first hasp bracket and said cover is pivoted about said hinge to be in covering relationship about said hasp; and wherein:

a lock is removably installed through said first and second locking holes to lock said hasp and to lock said security cover in covering relationship about said hasp.

8. A security device for a hasp, wherein:

said hasp is comprised of:

an elongate base plate configured at opposite first and second ends with respective first and second mounting holes and further configured at its second end with a locking hook extending perpendicularly from said base plate and opening toward said second end;

first and second base plate fasteners installed within respective said first and second mounting holes to secure said base plate to a mounting surface;

a fixed hasp bracket installed on said base plate by said first base plate fastener and configured to open toward said second end; and a rotating hasp bracket rotatably mounted substantially centrally on said base plate and configured to rotate toward said first end substantially adjacent to said fixed hasp bracket; and wherein:

said security device is comprised of:

a hinge having a hinge mounting plate and a hinge pivot plate interconnected along a hinge joint, said hinge mounting plate being installed on said base plate by said first base plate fastener such that said hinge joint is substantially aligned with said first end;

a security cover installed on said hinge pivot plate, said security cover being configured to pivotably mate with said base plate and being further configured with a bracket opening for receipt therethrough of said fixed hasp bracket and said rotating hasp bracket when said cover is pivoted about said hinge to be in covering relationship about said hasp; and a lock installed in said security cover opposite said second end and formed with a locking tab configured to rotatably engage said locking hook to lock said security cover in covering relationship about said hasp.

9. A method of securing a hasp lock, comprising the steps of:

selecting a hasp having a base plate and hasp brackets mounted thereon, at least one said bracket being movably mounted for selectively bringing said brackets into substantially abutting relationship for locking said hasp;

closing said hasp by moving said at least one said bracket into substantially abutting relationship with another said bracket;

selecting a security cover having an opening for partial receipt therethrough of said hasp brackets;

pivoting said security cover into covering relationship about said hasp such that said hasp brackets partially extend through said opening;

locking said hasp brackets; and locking said security cover.

10. The method of claim 9, comprising the further steps of:

selecting a security cover having a hinge, said hinge having a hinge mounting plate and a hinge pivot plate interconnected along a hinge joint, said security cover being mounted to said hinge pivot plate; and attaching said hinge mounting plate to said base plate.

* * * * *